US005653342A

United States Patent [19]

Eaton

[11] Patent Number: 5,653,342

[45] Date of Patent: Aug. 5, 1997

[54] ENCLOSURE FOR CARRYING AND PROTECTING A GOLF SCORECARD

[76] Inventor: James B. Eaton, 11249 NE. 36th Pl. #412, Bellevue, Wash. 98004

[21] Appl. No.: 577,803

[22] Filed: Dec. 22, 1995

[51] Int. Cl.[6] ..... B65D 85/28; B65D 85/67

[52] U.S. Cl. ..... 206/579; 206/38; 206/315.1; 206/555; 224/230

[58] Field of Search ..... 206/37, 38, 39, 206/214, 224, 232, 315.1, 315.2, 371, 449, 527, 579, 804, 815, 555; 273/148 R, 148 A, 150

[56] References Cited

U.S. PATENT DOCUMENTS

| | | | |
|---|---|---|---|
| 3,371,829 | 3/1968 | Phillips . | |
| 3,464,135 | 9/1969 | Eidinger | 206/232 |
| 3,481,458 | 12/1969 | Mayeaux | 206/804 |
| 3,799,331 | 3/1974 | White | 206/38 |
| 3,830,415 | 8/1974 | Jacobson et al. . | |
| 3,958,690 | 5/1976 | Gee, Sr. | 206/232 |
| 4,573,571 | 3/1986 | Leem | 206/214 |
| 4,645,105 | 2/1987 | Plumbridge . | |
| 4,700,840 | 10/1987 | Haddock | 206/39 |
| 4,746,045 | 5/1988 | Schweim . | |
| 5,031,653 | 7/1991 | Lynam . | |
| 5,158,179 | 10/1992 | Gosselin | 206/38 |

*Primary Examiner*—Jimmy G. Foster
*Attorney, Agent, or Firm*—Christensen O'Connor Johnson & Kindness PLLC

[57] ABSTRACT

An enclosure for protecting and carrying a golf scorecard is formed of a translucent or transparent material and takes the shape of a tubular member having a closed end and an open end. The tubular member is sized to receive a golf scorecard so that all the pertinent information regarding all 18 holes can be viewed through the walls of the enclosure. The closed end includes an aperture for receiving a writing device such as a pen or pencil. The enclosure is sized to be readily carried in a shirt or pants pocket of the golfer and serves to protect the card from the elements such as perspiration or precipitation.

8 Claims, 2 Drawing Sheets

ENCLOSURE FOR CARRYING AND PROTECTING A GOLF SCORECARD

FIELD OF THE INVENTION

The present invention relates to an enclosure for carrying and protecting a golf scorecard from the elements, for providing a form around which the scorecard can be formed so that the boxes for scoring all eighteen holes are conveniently visible, as well as other information on the scorecard, such as hole layout.

BACKGROUND OF THE INVENTION

Generally, golfers record their scores on golf scorecards which are printed on heavy paper. More often than not, the scorecards are carded by the golfer in a shirt pocket, pants pocket, or golf bag pouch. Such scorecards are typically of a size that requires they be folded over several times in order to fit within a shirt or pants pocket. Folding the scorecard introduces sharp corners that can easily catch on the sides of the opening in a pocket, making it difficult for the golfer to place the card in the pocket or remove it therefrom.

Carrying the scorecard in one's pocket suffers from several other drawbacks. For example, the scorecard can easily fall out of a pocket and be lost. In addition, since the scorecard is printed on a paper material, it is susceptible to damage by moisture from perspiration or precipitation. In addition to carrying a scorecard in one's pocket, the golfer must carry a separate pencil or pen with which to record the appropriate scores. Oftentimes, the pencil itself will be lost or it can injure the golfer's hands when he or she attempts to retrieve it from his pocket, or it may puncture a hole in the pocket itself.

One of the other drawbacks of carrying a scorecard in a pocket relates to the folding of the scorecard. Most scorecards are prefolded to allow the card to be folded so that only the scoring positions for nine holes are exposed. In order for a golfer to review the yardages, layouts or pars for the other nine holes, the scorecard must be removed from the pocket and unfolded.

In view of the foregoing drawbacks, there is a need for a convenient way to carry a golf scorecard in a golfer's pocket wherein the scorecard is less likely to be lost or damaged and, preferably, whereby a writing instrument can be associated with the scorecard.

There is also a need for a means of carrying a scorecard where information regarding all 18 holes can be readily observed.

Other types of scorecard holders have been proposed such as those described in U.S. Pat. No. 4,746,045 which is designed to be readily attached to a golf bag. U.S. Pat. No. 3,830,415 describes a "pocket protector" type of device for carrying a scorecard, pencil, divot fork, tees, ball markers and the like. Another scorecard carder is described in U.S. Pat. No. 4,645,105. Although each of these devices addresses some of the problems noted above, none of them addresses the problems in a particularly effective manner.

SUMMARY OF THE INVENTION

The present invention provides a simple and effective enclosure for protecting the scorecard from the elements such as perspiration or precipitation as well as providing a more secure way of retaining the scorecard in a golfer's pocket. The translucent feature of the enclosure allows the golfer to fold most scorecards so that the scoring positions for all 18 holes can be observed. The translucent feature also allows the golfer to view information on the folded under portions of the scorecard which will typically be the top and bottom edges of the scorecard. This allows the golfer to avoid having to repeatedly unfold the scorecard so that he can look at upcoming holes. Also, the folding of the scorecard so it fits into the enclosure of the present invention renders the scorecard stiff enough so that the golfer can record scores by sliding the card from within the enclosure only so far as needed to expose the needed hole.

In one embodiment, the present invention includes a hollow translucent tubular member having an open end and a closed end, wherein the closed end includes an aperture sized to releasably receive the writing portion of a writing device. In a particularly preferred embodiment, the tubular member includes opposing rear and front walls wherein the rear wall is convex in shape and the front wall is concave in shape.

The enclosure is preferably made from a plastic material which is durable, firm and semirigid, but malleable.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

A preferred embodiment of an enclosure formed in accordance with the present invention for receiving a golf scorecard is illustrated in FIGS. 1–4. The illustrated embodiment includes a slightly curved profile across its width, allowing it to readily fit into a golfer's rear pants pocket or a shirt pocket. While such embodiment is preferred, it should be understood that the present invention is not limited to a curved enclosure, but also includes enclosures wherein the opposing walls are substantially flat. Furthermore, while the illustrated embodiment is preferably carried in the golfer's pocket as described above, it should be understood it is not a requirement of the present invention. For instance, the enclosure can be carded elsewhere, such as in or on the golfer's golf bag. A clip or other retaining device could be used to attach the enclosure to a hook or loop on the golfer's golf bag or clothing.

Figure 1:
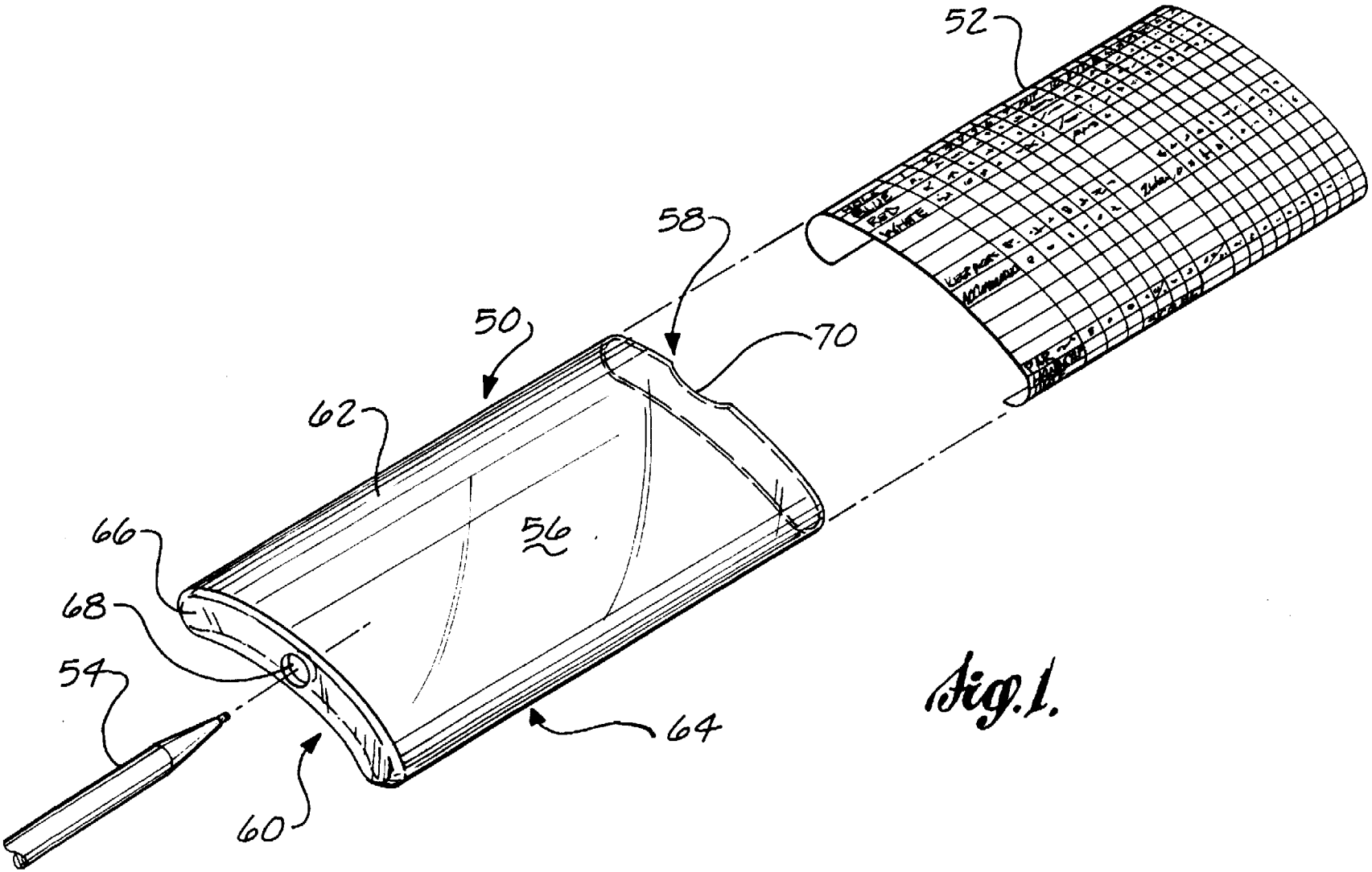
FIG. 1 is a perspective view of an enclosure formed in accordance with the present invention about to receive a golf scorecard and a writing device.

Referring to FIG. 1, an enclosure 50 formed in accordance with the present invention is illustrated in combination with a scorecard 52 and a writing device 54. Enclosure 50 comprises a hollow, translucent tube 56 having an open end 58 through which the scorecard is inserted and a closed end 60 opposite the open end.

Figure 2:
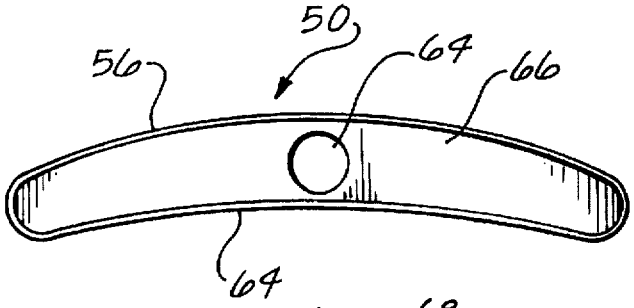
FIG. 2 is an end view of the enclosure of FIG. 1 taken along line 2—2.
Figure 3:
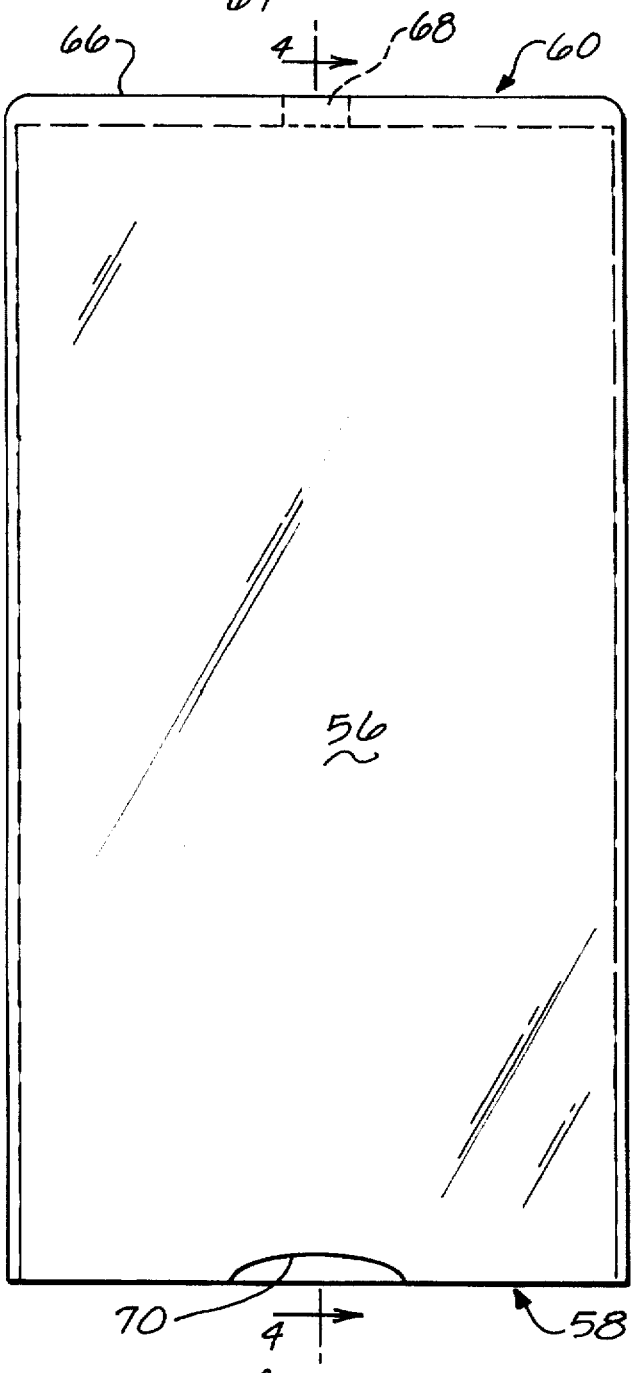
FIG. 3 is a plan view of the rear wall of the enclosure of FIG. 1.
Figure 4:
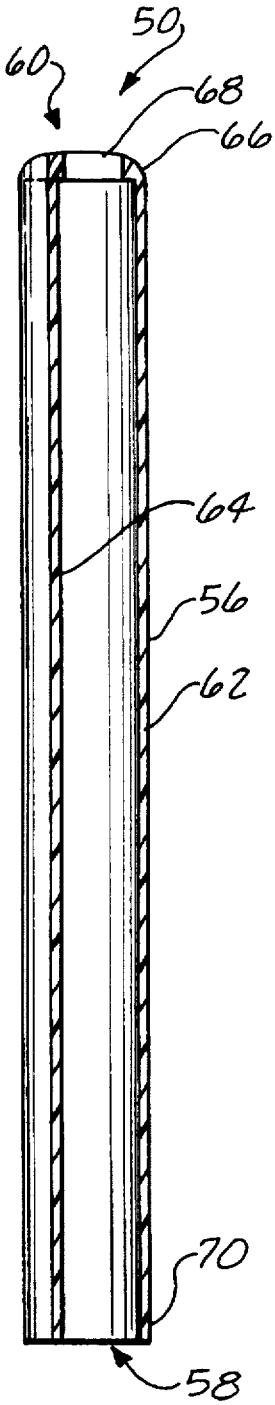
FIG. 4 is a view of a cross section taken along line 4—4 in FIG. 3.

Referring additionally to FIGS. 2–4, tube 56 in the illustrated embodiment comprises rear wall 62 and front wall 64. The rear and front designation are intended to describe the surfaces of tube 56 relative to the way that the enclosure 50 preferably fits in a golfer's rear pants pocket.

Thus, front wall 64 would face in the same direction as the front side of the golfer and rear wall 62 would face in the same direction as the rear side of the golfer. In the illustrated embodiment, rear wall 62 in cross-section parallel to its width is substantially convex in shape and front wall along the same cross-section is substantially concave. Rear wall 62 includes a left and right edge that are joined respectively to the left and right edge of front wall 64.

In the illustrated embodiment, the end of tubular element 56 adjacent writing device 54 is substantially closed by an end plug 66. End plug 66 can take the form of a plug which is inserted into the end of tubular member 56 and secured therein by glue or some other bonding means, or closed end 60 can be provided by a molded plug which is provided when rear wall 62 and front wall 64 are formed as described below in more detail. Located in the center of end plug 66 is an aperture 68, (circular in the illustrated embodiment) sized to releasably receive a writing device 54 such as a pen or pencil. The size and shape of aperture 68 is such that a portion of the writing device can pass through the aperture into the interior of hollow enclosure 50, while the eraser portion or clip portion of the writing device cannot pass therethrough. Preferably, the size and shape of the aperture is very similar to the shape and size of the cross-section of the writing device. In this manner, aperture 68 secures the writing device to the enclosure for convenient access by the golfer when a score needs to be recorded.

At the end of tube 56, opposite closed end 60, is open end 58. A cut out portion 70 is centered along the end of rear wall 62 that serves to define open end 58. Cut out portion 70 allows the golfer to grasp scorecard 52 and easily remove it from within enclosure 50 without having to stick his or her fingers into the tube. In the illustrated embodiment, cut out portion 70 is in the shape of an ellipse; however, it should be understood that other shapes can be employed so long as they provide a means for the golfer to grasp the scorecard.

In the preferred embodiment illustrated in FIG. 1, the enclosure 50 with its convex rear wall 62 and concave front wall 64 has a shape similar to a "flask" for carrying spirits. In the illustrated embodiment, rear wall 62 and front wall 64 each have profiles perpendicular to the length of enclosure 50 that trace isometric ellipses. In the illustrated embodiment, the isometric ellipse that tracks the profile of rear wall 62 is a 6.5 inch isometric ellipse. The isometric ellipse that tracks the profile of from wall 64 in the illustrated embodiment is a 4.25 inch isometric ellipse. While an enclosure with the foregoing dimensions is preferred, it should be understood that the present invention is not limited to the particular dimensions give above. Again, in a preferred embodiment, the overall width of the enclosure is about 3.5 inches. Preferably, the left and right edges of rear wall 62 and front wall 64 join together in a smooth transition to provide a smooth surface which is less likely to cause injury to the golfer's hand, damage clothing, or get caught on the clothing. In the illustrated embodiment, the corner defined by the left and right edges of front wall 64 and rear wall 62 tracks a 9/16th inch 45° ellipse. Likewise, the four corners of the enclosure are preferably rounded to permit the easy insertion and removal of the enclosure from a golfer's pocket or golf bag pouch. In addition, the rounded edges and corners reduce the likelihood that the golfer will catch his or her hand, or clothing on sharp edges. In order to provide rounded edges and corners at closed end 60, end plug 66 should be thick enough to allow rounding of the corners and edges without creating a hole into the interior of enclosure 50. The overall length of enclosure 50 is chosen so that substantially the entire scoring portion of a golf scorecard can be viewed. The scoring portion of a golf scorecard includes those portions where the golfer's names are recorded and their respective scores. In addition to being sized to completely protect the scorecard, the length of the enclosure is preferably such that it extends slightly out of a pants pocket or shirt pocket so that the golfer can readily remove it from the pocket.

Typically, a length on the order of about 6.75 inches will be sufficient; however, it should be understood that the present invention is not limited to any particular length.

As described above, aperture 68 in closed end 60 is centered in closed end 60 between rear wall 62, front wall 64, and the left and right edges of rear wall 62 and front wall 64. In order to provide a sufficient surface in which to machine aperture 68, the distance between the interior of rear wall 62 and front wall 64 must be greater than the diameter of aperture 68. In a preferred embodiment, the distance between rear wall 62 and front wall 64 is approximately 0.5 inches when measured at the thickest point of enclosure 50.

Without intending to be limited to any particular diameter or shape, applicants have found that a round aperture having an inner diameter of approximately ⅜" is sufficient to allow the writing end of a pencil or pen to be inserted through the aperture while the ribs of the eraser or clip cannot pass therethrough. In this manner, the writing device is associated with the enclosure and is thus readily available for the golfer to use when recording scores.

The enclosure formed in accordance with the present invention is preferably formed from a clear or translucent material so that the golfer can readily observe the yardages, pars, ratings and other information about the golf course without removing the scorecard from the enclosure. Many plastics will provide a suitable material for the manufacture of an enclosure formed in accordance with the present invention. Suitable plastics will be rigid enough so that the enclosure maintains its shape after being carded in a golfer's shirt or pants pocket, or otherwise crushed or bent. In other words, in addition to being relatively firm, the material used to make the enclosure should be flexible and elastic so that it returns to its original shape. Suitable materials will not be slippery and should provide sufficient friction so that the golfer can readily remove the enclosure from a pocket or insert it into a pocket. In addition, the plastic should be scuff resistant and waterproof or water resistant so that the scorecard is not damaged by moisture from souses such as perspiration or precipitation.

The enclosure formed in accordance with the present invention can be manufactured using conventional plastics forming techniques such as injection molding or extrusion.

The enclosure provides a golfer with a simple and effective means for carrying and protecting a golf scorecard. Because the enclosure is relatively firm or rigid, the golfer can use the enclosure as a form for folding and shaping the scorecard so that it will fit conveniently within the hollow interior of the enclosure. Because of the shape and size of the enclosure, most scorecards will be able to be folded and shaped such that all of the pertinent information regarding the playing partner's names, yardages, ratings, pars, playing times, handicap numbers, and scores can be displayed continuously throughout the round through the clear walls of the enclosure. It may be that certain portions of the scorecard are folded under in order to fit the scorecard within the enclosure. The information printed on the folded under portions can still be viewed without removing the scorecard in the preferred embodiment because of the translucent front and rear wall. Once the scorecard has been formed around the outer surface of enclosure 50, it can be inserted into open end 58 until it abuts up against closed end 60. Folding the scorecard in this unique manner, in addition to providing ready viewing, also tends to stiffen the scorecard further so that it can be readily written upon when scores are being recorded. Preferably, when recording scores, the golfer can slide the scorecard partially out of the enclosure to expose the necessary portion. The stiffening introduced by the folding as described above makes it easy for the golfer to record the scores.

In addition to providing a means for protecting and carrying a scorecard, the enclosure also simply and effectively ensures that a writing device is associated with the scorecard and that the writing device does not cause injury to the golfer when it is retrieved from a pocket or bag, or does not poke a hole in the pocket of the golfer.

While the enclosure for protecting and carrying a golf scorecard has been described above with reference to a particular, preferred embodiment, it should be understood that other embodiments, such as one wherein the rear wall and front wall do not have a profile that tracks an ellipse will also provide many of the advantages described above. For example, flat front and rear walls can also be employed. In addition, the present invention is not limited to enclosures wherein both the from wall and the rear wall are translucent or transparent, although this is a preferred embodiment. For example, as long as one of the walls is translucent or transparent, the golfer will be able to view a majority of the pertinent information on the scorecard. Also, as noted above, the illustrated embodiment of an enclosure formed in accordance with the present invention has been described above in the context of preferred dimensions. It should be understood that enclosures having other dimensions will also fall within the scope of the present invention.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An enclosure for receiving a golf scorecard and a writing device, said enclosure having a top end, an opposing bottom end, and an exterior, comprising:

a translucent front wall having an elongate left edge and an elongate fight edge, wherein the front wall is concave with respect to the exterior of the enclosure;

a translucent rear wall having an elongate left edge and an elongate fight edge, wherein the rear wall is convex with respect to the exterior of the enclosure, the front wall being spaced from the: rear wall, the left edge of the front wall connected to the left edge of the rear wall, and the fight edge: of the front wall connected to the right edge of the rear wall to form the enclosure as a hollow member, the enclosure being closed at the top end and being open at the bottom end; and an aperture in the closed top end sized to releasably receive a writing device.

2. The enclosure of claim 1 wherein the rear wall at the open end includes a cut out portion.

3. The enclosure of claim 1 wherein the front and rear wall are made of a plastic material.

4. An enclosure for receiving a golf scorecard and a writing device, said enclosure having a top end, an opposing bottom end, and an exterior, comprising:

a front wall having an elongate left edge and an elongate right edge;

a translucent rear wall having an elongate left edge and an elongate right edge, wherein the rear wall is entirely curved to be convex with respect to the exterior of the enclosure, the front wall being spaced from the rear wall, the left edge of the front wall connected to the left edge of the rear wall, and the fight edge of the front wall connected to the fight edge of the rear wall to form the enclosure as a hollow member, the enclosure being closed at the top end and being open at the bottom end; and an aperture in said closed top end sized to releasably receive a writing device.

5. The enclosure of claim 4, wherein the front wall is translucent.

6. The enclosure of claim 4, wherein the front wall is concave with respect to the exterior of the enclosure.

7. The enclosure of claim 4, wherein the rear wall at the open end includes a cut out portion.

8. The enclosure of claim 4, wherein the front and rear wall are made of a plastic material.

* * * * *

UNITED STATES PATENT AND TRADEMARK OFFICE

CERTIFICATE OF CORRECTION

PATENT NO. : 5,653,342

DATED : August 5, 1997

INVENTOR(S) : J.B. Eaton

It is certified that error appears in the above-indentified patent and that said Letters Patent is hereby corrected as shown below:

| COLUMN | LINE | |
|---|---|---|
| 6 | 2 | "fight" should read --right-- |
| (Claim 1, | line 5) | |
| 6 | 5 | "fight" should read --right-- |
| (Claim 1, | line 8) | |
| 6 | 7 | "the:" should read --the-- |
| (Claim 1, | line 10) | |
| 6 | 9 | "fight edge:" should read --right edge-- |
| (Claim 1, | line 12) | |
| 6 | 15 | after "claim 1" insert --,-- |
| (Claim 2, | line 1) | |
| 6 | 17 | after "claim 1" insert --,-- |
| (Claim 3, | line 1) | |

UNITED STATES PATENT AND TRADEMARK OFFICE

CERTIFICATE OF CORRECTION

PATENT NO. : 5,653,342

DATED : August 5, 1997

INVENTOR(S) : J.B. Eaton

It is certified that error appears in the above-indentified patent and that said Letters Patent is hereby corrected as shown below:

| COLUMN | LINE | |
|---|---|---|
| 6 | 29 | "fight" should read --right-- |
| (Claim 4, | line 11) | |
| 6 | 30 | "fight" should read --right-- |
| (Claim 4, | line 12) | |

Signed and Sealed this

Ninth Day of December, 1997

*Attest:*

*Attesting Officer*

BRUCE LEHMAN

*Commissioner of Patents and Trademarks*